US005387046A

United States Patent [19]

Danno

[11] Patent Number: 5,387,046

[45] Date of Patent: Feb. 7, 1995

[54] APPLYING IMPLEMENT HAVING AN APPLICATION TIP SHIFTABLE INDEPENDENTLY OF A VALVE MEMBER

[75] Inventor: Akira Danno, Osaka, Japan

[73] Assignee: Kabushiki Kaisha Mikado Seisakusho, Osaka, Japan

[21] Appl. No.: 142,539

[22] Filed: Oct. 25, 1993

[30] Foreign Application Priority Data

Mar. 26, 1993 [JP] Japan ..... 5-068412
Jun. 23, 1993 [JP] Japan ..... 5-152033

[51] Int. Cl.[6] ..... B43K 8/00; B43K 8/16; B43K 8/18

[52] U.S. Cl. ..... 401/260; 401/264; 401/284

[58] Field of Search ..... 401/260, 264, 259, 284

[56] References Cited

U.S. PATENT DOCUMENTS

| | | | |
|---|---|---|---|
| 1,141,522 | 6/1915 | Boyajean | 401/260 |
| 2,029,152 | 1/1936 | Bonkowski | 401/260 X |
| 3,003,184 | 10/1961 | Rosenthal | 401/260 X |
| 3,016,171 | 1/1962 | Becher | 401/264 X |
| 3,475,105 | 10/1969 | Gerson | 401/260 |
| 4,217,994 | 8/1980 | Koenig et al. | 401/264 X |

FOREIGN PATENT DOCUMENTS

| | | | |
|---|---|---|---|
| 1133941 | 11/1956 | France | 401/264 |
| 638557 | 9/1984 | Japan | 401/264 |
| 62-66780 | 4/1987 | Japan | 401/264 |
| 288459 | 1/1953 | Switzerland | 401/260 |

*Primary Examiner*—Steven A. Bratlie
*Attorney, Agent, or Firm*—Jordan and Hamburg

[57] ABSTRACT

An applying implement including: a main body having an application fluid storage; a head cylinder having a front end portion having an opening, a rear end portion having a communication hole communicating to the application fluid storage, and a tapered portion formed between the front and rear end portions so as to increase its radius as it advances rearward; a valve body having a shape fitted to an inside surface of the tapered portion around it, and being made of a soft and resilient material and accommodated inside the head cylinder so as to be slidable in an axial direction; an urging member for resiliently urging the valve body forward so that the valve body can be firmly pressed against the inside surface of the tapered portion by urging force of this urging member; and an application tip provided in front of and independent of the valve body in the head cylinder, so as to be shiftable in the axial direction until it protrudes out of the head cylinder, and the application tip being spaced from a front edge of the valve body when shifted to an outermost position.

19 Claims, 9 Drawing Sheets

APPLYING IMPLEMENT HAVING AN APPLICATION TIP SHIFTABLE INDEPENDENTLY OF A VALVE MEMBER

BACKGROUND OF THE INVENTION

1. Field of the Invention

This invention relates to an applying implement which contains an application fluid, such as correction liquid, and applies it onto an application surface.

2. Description of the Prior Art

There has been conventionally known an applying implement equipped with a valve mechanism which allows an application fluid to be applied on an application surface even if the application fluid has a large viscosity as a correction liquid. For example, Unexamined Japanese Utility Model Publication No. HEI 2-48172 discloses such an applying implement.

FIG. 10 shows a conventional applying implement, wherein a structure of a head portion (a lower portion in the drawing) is shown in detail. In the drawing, a main body 90 of the applying implement is secured with a head cylinder 92. The head cylinder 92 includes a front end wall 91 provided at the front end thereof. The front end wall 91 has a through hole 93 opened in the central portion thereof.

The head cylinder 92 accommodates a shaft 94 therein so as to allow the shaft 94 to shift in an axial direction of the applying implement (i.e. in the up-and-down direction in the drawing). A pen tip (i.e. an application tip) 95 is securely fixed to the front end of the shaft 94. A spring 96 is provided between the pen tip 95 and the main body 90 so as to urge the pen tip 95 forward (i.e. downward in the drawing). The pen tip 95 chiefly consists of a head portion 95*a* and a tail portion 95*b*. The head portion 95*a* has a diameter smaller than that of the through hole 93 so that it can protrude out of the bead cylinder 92. The tail portion 95*b* bas a diameter larger than that of the through hole 93. There is provided a convex spherical surface 97 between the head portion 95*a* and the tail portion 95*b*. This convex spherical surface 97 serves as a shoulder abutting the inside surface of the front end wall 91 around the through hole 93. The inside surface of the front end wall 91 is a concave spherical surface 98 having a radius of curvature larger than that of the convex spherical surface 97. Thus, the convex spherical surface 97 and the concave spherical surface 98 come into contact with each other around the through bole 93 so as to define a seal between the bead cylinder 92 and the pen tip 95.

Namely, when no external force is applied against the pen tip 95, the spring 96 urges the pen tip 95 to extend forward (i.e. downward in FIG. 10) and therefore the convex spherical surface 97 is pressed to fit to the concave spherical surface 98. Thus, the through hole 93 is completely closed. On the contrary, if the pen tip 95 is pressed against paper or the like material for application of fluid, the pen tip 95 receives a reaction force and retracts inward together with the shaft 94 against the resilient force of the spring 96. This retracting motion of the pen tip 95 and the shaft 94 causes application fluid in the head cylinder 92 to flow forward beyond the clearance between the convex spherical surface 97 and the concave spherical surface 98. And, after passing through the through hole 93, the application fluid is extracted out of the head cylinder 92 and is then supplied onto the paper or the like application surface.

However, such a conventional applying implement shown in FIG. 10 has problems as described below.

(a) Recently, there has been increasing a need of developing an applying implement which allows an application fluid to be accurately applied within a limited small area. In order to realize such a fine application of fluid to a very small area, it is needless to say that the radius size of the pen tip 95 must be reduced. Furthermore, it is essential to reduce the radius size of the head cylinder 92 because an application area must be seen by an operator during the application of fluid without being hidden behind the head cylinder 92. For this reason, these components 92 and 95 will be required to be made of a hard material such as metal, and ceramic or other inorganic material.

However, if the head cylinder 92 and the pen tip 95 are both made of hard materials, the seal between the convex spherical surface 97 and the concave spherical surface 98 will be worsened because contact of two hard materials usually provides poor sealing ability. Requirement of accuracy to the convex spherical surface 97 and the concave spherical surface 98 may be enhanced for increasing the sealing ability but would be accompanied with an increase of cost.

(b) As the pen tip 95 itself serves as a valve, it tends to allow foreign particles such as dirt or dust to enter inside the head cylinder 92 beyond the sealing part. This foreign particles become the case of further deteriorating the sealing ability. Especially, in the case where the convex spherical surface 97 and the concave spherical surface 98 are both made of hard materials, the seal ability will be greatly lowered even if an entering foreign particle is very small.

(c) If the application fluid has too large viscosity to freely drop or come out of the head cylinder 92 upon opening the sealing part at the pen tip 95, the main body 90 of the applying implement will be generally squeezed to forcibly extract the fluid. Such a forcible extraction, however, makes it difficult to finely adjust the application fluid amount to be supplied because a large amount of fluid is likely to come out of the through hole 93 at a time.

(d) When pressed against paper or the like material, the pen tip 95, if made of hard material, normally transmits a reaction force directly to a user's hand. Therefore, no comfortable feeling will be enjoyed when used.

SUMMARY OF THE INVENTION

Accordingly, the present invention has an object to provide an applying implement which has overcome the above-described problems in the prior art.

In order to accomplish this object, a first aspect of the present invention provides an applying implement comprising.

a main body having an application fluid storage;

a head cylinder including a front end portion having an opening, a rear end portion having a communication hole communicating to the application fluid storage, and a tapered portion formed between the front and rear end portions so as to increase its radius as it advances rearward;

a valve body having a shape fitted to an inside surface of the tapered portion around it, and being made of a soft and resilient material and accommodated inside the head cylinder so as to be slidable in an axial direction;

an urging member for resiliently urging the valve body forward so that the valve body can be firmly pressed against the inside surface of the tapered portion by urging force of this urging member; and an application tip provided in front of and independent of the valve body in the bead cylinder, so as to be shiftable in the axial direction until it protrudes out of the head cylinder, and the application tip being spaced from a front edge of the valve body when shifted to an outermost position.

Next, a second aspect of the present invention provides an applying implement in which the head cylinder and the application tip are made of a hard material such as metal or inorganic material.

Furthermore, a third aspect of the present invention provides an applying implement in which the front end portion of the head cylinder has a cross section smaller than that of the rear end portion of the head cylinder.

Still further, a fourth aspect of the present invention provides an applying implement in which a guide member is interposed between the urging member and the valve body. The guide member is at least partly formed into a shape capable of slidable contact with the inside surface of the head cylinder.

Yet further, a fifth aspect of the present invention provides an applying implement in which the application tip has an engaging portion fitting to the inside surface of the tapered portion around it.

Moreover, a sixth aspect of the present invention provides an applying implement in which the application tip is at least partly formed into a shape capable of slidable contact with the inside surface of the front end portion of the head cylinder.

Furthermore, a seventh aspect of the present invention provides an applying implement in which the application tip is at least partly formed in a modified cross-sectional portion having a plurality of ridges which come into slidable contact with the inner surface of the front end portion of the head cylinder. Surfaces between these ridges are respectively formed into a convex arc surface having a curvature radius larger than the inner surface of the front end portion.

Still further, an eighth aspect of the present invention provides an applying implement in which the valve body is formed into a circular column shape.

Yet further, a ninth aspect of the present invention provides an applying implement in which the valve body is formed into a ball shape.

Moreover, a tenth aspect of the present invention provides an applying implement in which the urging member is constructed by a compression coil spring having an inner diameter smaller than an outer diameter of the valve body. The valve body is coupled or inserted into an edge portion of the compression coil spring.

Furthermore, an eleventh aspect of the present invention provides an applying implement in which the end portion of the compression coil spring is formed into an end coil portion wherein adjacent wires of the coil spring abut with each other. The turning number of the end coil portion is selected to be an appropriate number so that the upper portion of the valve body can be sufficiently inserted into this end coil portion.

Still further, a twelfth aspect of the present invention provides an applying implement in which the compression coil spring has the same outer diameter as that of the valve body.

Finally, a thirteenth aspect of the present invention provides an applying implement in which the head cylinder has a bottom wall having a through hole at the rear end portion thereof. The urging means is a compression coil spring interposed between the bottom wall and the valve body, and the main body is formed with a head cylinder installation hole communicating to the application fluid storage so that the head cylinder can be installed in this head cylinder installation hole.

In accordance with the first aspect of the present invention, when no external force is applied to this valve body, the valve body is pressed against the inside surface of the tapered portion of the head cylinder by the urging force of the urging member. Thus formed seal prevents the application fluid from coming out of the head cylinder. As the valve body is made of the soft and elastic material and is independently spaced from the application tip, the valve body can surely fit to the tapered portion of the head cylinder regardless of the condition (material, position, and others) of the application tip.

Furthermore, as the sealing portion is located at an inner part behind the application tip, foreign particles seldom reach this sealing portion and also the application fluid will cause no dry.

Next, if the application tip is pressed against paper or the like material to be supplied with fluid, the application tip shifts inward with respect to the head cylinder due to reaction force. First of all, only the application tip moves inward until it reaches the valve body. Then, the application tip and the valve body integrally shift together inward in the axial direction thereof against the elastic force of the urging member. Thus, the application tip and the valve body completely depart from the inside surface of the tapered portion.

In this case, a front side chamber of the head cylinder, located in front of the valve body, quickly expands its volume. At this moment, the front side chamber causes a negative pressure because introduction of air from outside is delayed by the resistance of the application fluid passage between the application tip and the head cylinder. Due to this negative pressure, an application fluid behind the valve body is once introduced into the expanded space of the front side chamber. Thereafter, if the application tip is released from the external force, it returns to the outermost position being urged by the urging member. In response to this returning motion of the application tip, a relatively small amount of application fluid, corresponding to the above expanded space, is extracted out of the head cylinder and then supplied onto the paper or the like material.

Furthermore, the external force applied from the paper or the like material to the application tip is softly transmitted to the user's hand because this force is transmitted through the soft and resilient valve body.

As described above, the application tip and the valve body are independent form each other. Therefore, even if the head cylinder and the pen tip are made of metal or inorganic material according to the second aspect of the present invention, the seal ability can be maintained nicely because the valve body made of a soft and resilient material serves as an excellent seal member. Hence, the radiuses of both the head cylinder and the application pen tip will be further reduced as long as the required strength is assured, without being bothered by the seal ability. With this arrangement, it becomes possible to supply an application fluid within a limited very small area.

In accordance with the third aspect of the present invention, the front end portion of the head cylinder has an outer diameter smaller than that of the rear end portion of the head cylinder. Thus, the user can easily see a target point to be supplied with the fluid. This will be especially advantageous when the application fluid is applied to a very small area.

In accordance with the fourth aspect of the present invention, the guide member is interposed between the valve body and the urging member. This guide member is partly formed in a shape capable of slidable contact with the inside surface of the head cylinder. Therefore, the guide member and the valve body can shift accurately in the axial direction being guided by the inside surface of the head cylinder. Thus, not only it becomes possible to prevent the guide member and the valve body from fluctuating in the radial direction but at least one application fluid passage having sufficient area can be formed between the guide member and the head cylinder.

Furthermore, the structure in accordance with the fifth aspect of the present invention prevents the application tip from falling out. As the engaging portion can come into contact with the tapered portion at a wider area around it, the application fluid can be positively prevented from leaking out of the head cylinder.

Still further, in accordance with the sixth aspect of the present invention, the application tip has a shape capable of slidable contact with the inside surface of the head cylinder. Therefore, the application tip can shift accurately in the axial direction being guided by the inside surface of the head cylinder. Thus, not only it becomes possible to prevent the application tip from fluctuating in the radial direction but at least one application fluid passage having sufficient area can be formed between the application tip and the head cylinder.

Especially, in accordance with the seventh aspect of the present invention, the application tip has outwardly protruding convex surfaces between the ridges. Therefore, frictional damage at respective ridges will be adequately suppressed to a certain extent. A clearance between the outer surface of the application tip and the inside wall of the head cylinder can be shortened.

In accordance with the eighth aspect of the present invention, as the valve body is formed into a circular column shape, it can serve as a piston capable of generating strong extraction force when it returns from the retracted position to the protruding position.

In accordance with the ninth aspect of the present invention, as the valve body is formed into a ball shape, the valve body can come into contact with the tapered portion around it even if the inclined angle of the tapered portion is set smaller. Thus, excellent seal ability can be maintained. Hence, the front end portion of the head cylinder can be thinned.

Moreover, in accordance with the tenth aspect of the present invention, the urging member is constructed by the compression coil spring having the inner diameter smaller than the outer diameter of the valve body and the valve body coupled or engaged into the edge portion of the compression coil spring. Therefore, no valve seat or the like component is required between them.

In accordance with the eleventh aspect of the present invention, the end portion of the compression coil spring is formed into an end coil portion wherein adjacent wires of the coil spring abut with each other. Thus, the valve body can be stably supported. Especially, by selecting the turning number of the end coil portion to be an appropriate value, the end coil portion can serve as the valve seat or the like component and the supporting of the valve body is ensured.

Still further, in accordance with the twelfth aspect of the present invention, the outer diameter of the compression coil spring is set to be substantially the same as the outer diameter of the valve body. Thus, it becomes possible to firmly support the valve body. The interference between the compression coil spring and the inside surface of the head cylinder can be surely prevented.

Yet further, in accordance with the thirteenth aspect of the present invention, the head cylinder includes the bottom wall and is formed into a container-like shape so that the compression coil spring can be accommodated therein. Thus, the front end portion of the applying implement can be incorporated into a unit structure. Especially, it is advantageous in that no spring stopper is needed. Consequently, in the installation, the applying implement can be simply assembled by merely inserting the united head cylinder into the head cylinder installation hole formed on the head cylinder holder.

The above and other objects, features and advantages of the present invention will become more apparent from the following detailed description which is to be read in conjunction with the accompanying drawings.

DETAILED DESCRIPTION OF THE PREFERRED EMBODIMENTS

Hereinafter, preferred embodiments of the present invention will be described in detail with reference to accompanying drawings. Although the embodiments of the present invention exemplarily show a correction pen applying an opaquing fluid for deletions and changes, it is needless to say that this invention can be widely applied to any other applying implement such as paint marker, Indian ink, and manicure.

Figure 1:
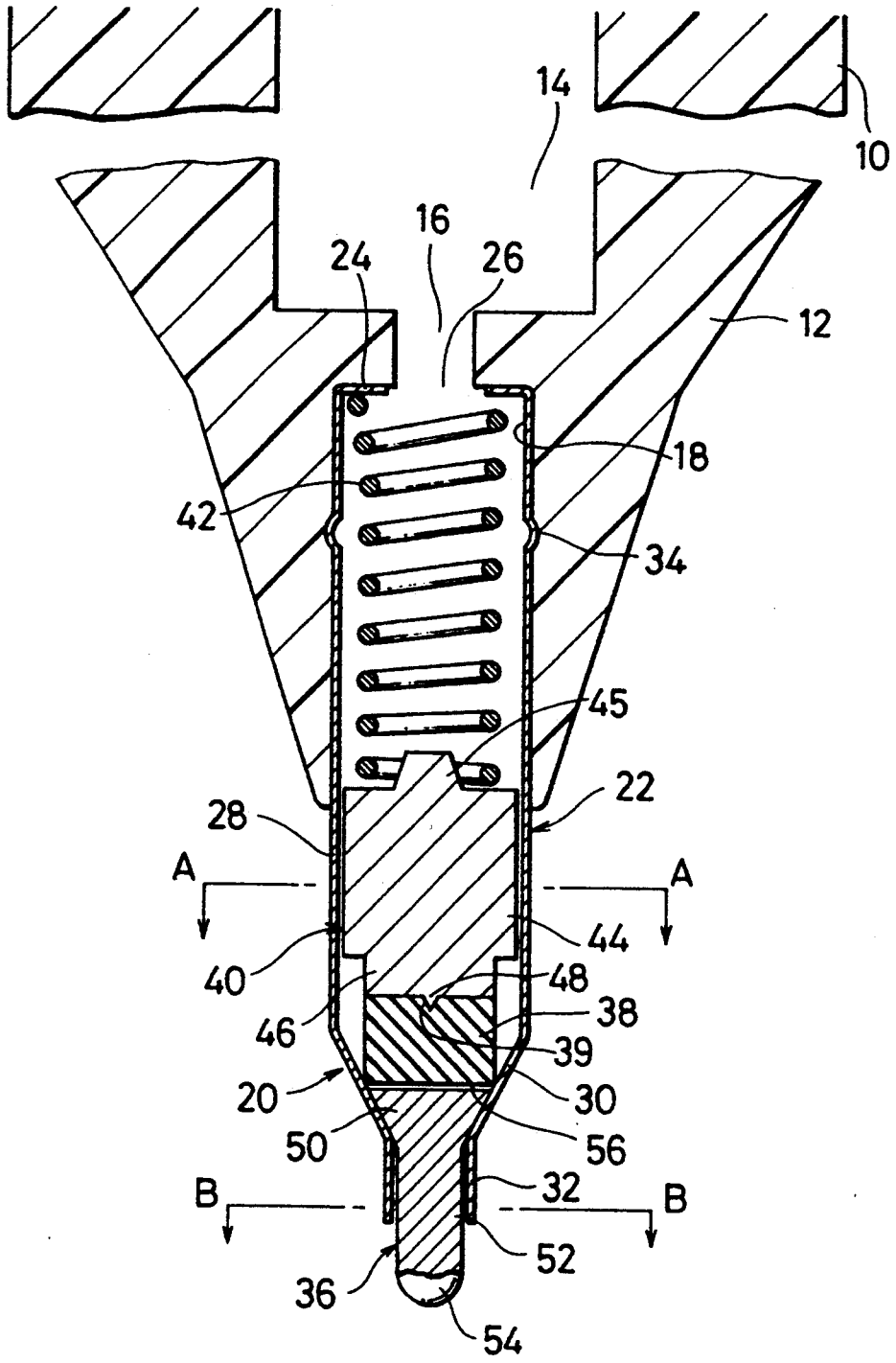
FIG. 1 is a cross-sectional front view showing an essential part of an applying implement in accordance with a first embodiment of the present invention.

A first embodiment of the present invention will be described with reference to FIGS. 1–4. In FIG. 1, reference numeral 10 represents a container and reference numeral 12 represents a head cylinder holder. These container 10 and the head cylinder holder 12 define a main body of the applying implement. An application fluid storage 14 is formed inside the main body so as to extend in an axial direction thereof. These container 10 and the head cylinder holder 12 are made of elastically deformable synthetic resin material.

The head cylinder holder 12 is formed with a head cylinder installation hole 18 at a central portion of the front end thereof. The head cylinder installation hole 18 has an open end at a front end thereof, i.e. a downward end in the drawing. The head cylinder installation hole 18 is communicated with the application fluid storage 14 via a through hole 16. A head cylinder 20 is received by the head cylinder installation hole 18 and firmly fixed there.

The head cylinder 20 is made of a hard material (i.e. metal material such as stainless steel, an inorganic material such as ceramic, or the like). The head cylinder 20 comprises a cylindrical side wall 22 and a bottom wall 24, and is formed into a container-like shape having a front opening end. The bottom wall 24 is formed with a communication hole 26 at a central portion thereof so as to define a communication passage together with the through hole 16.

The cylindrical side wall 22 consists of a larger-diameter cylindrical portion (i.e. a rear end portion) 28, a tapered portion 30, and a smaller-diameter cylindrical portion (i.e. a front end portion) 32. The larger-diameter cylindrical portion 28 is inserted into the head cylinder installation bole 18. A notched portion 34 is formed at an appropriate portion on the larger-diameter cylindrical portion 28 for preventing the head cylinder 20 from falling down. The tapered portion 30 is formed in a circular truncated cone whose cross section or diameter decreases as it advances forward (i.e. downward in FIG. 1). Accordingly, the larger-diameter cylindrical portion 28 has a diameter larger than that of the smaller-diameter cylindrical portion 32.

Figure 2A:
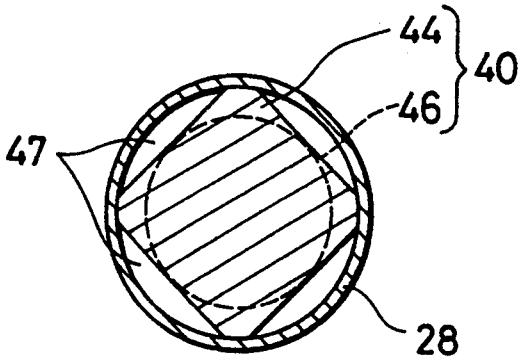
FIG. 2(A) is a cross-sectional plan view taken along the line A—A of FIG. 1.

The head cylinder 20 accommodates a pen tip (i.e. an application tip) 36, a valve body 38, and a guide member 40 in this order from the front end thereof. The guide member 40 is made of the same hard material as the head cylinder 20. As shown in FIGS. 2(A) and 3(A), the guide member 40 consists of a rectangular column portion 44 formed at the rear side thereof and a circular column portion 46 formed at the front side thereof. These rectangular column portion 44 and the circular column portion 46 are integrally formed. The rectangular column portion 44 has a cross section of substantially square, four corners of which come into slidable contact with the inside surface of the larger-diameter cylindrical portion 28. It is, of course, preferable to provide a slight gap between the four corners of the rectangular column portion 44 and the inside surface of the larger-diameter cylindrical portion 28. Four application fluid passages 47, - - - , 47 are provided between the rectangular column portion 44 and the larger-diameter cylindrical portion 28 due to the difference of their cross sections as shown in FIG. 2(A). The outer diameter of the circular column portion 46 is set smaller than an inside diameter of the larger-diameter cylindrical portion 28. The rectangular column portion 44 has a rear end surface formed with a spring stopper portion 45 protruding rearward (i.e. upward in FIG. 1). The circular column portion 46 has a front end surface formed with a valve body engaging portion 48 protruding forward (i.e. downward in FIG. 1).

The valve body 38, made of a soft and resilient material or a viscoelastic material such as hard rubber or soft resin, is a circular column having substantially the same lateral cross section as that of the circular column portion 46. The diameter of the valve body 38 is smaller than the inner diameter of the larger-diameter cylindrical portion 28 and is larger than the inner diameter of the smaller-diameter cylindrical portion 32. In other words, as shown in FIG. 1, the valve body 38 is designed to just abut or come into contact with the inside surface of the tapered portion 30 around the front circumferential peripheral edge thereof. Furthermore, the valve body 38 has a rear end surface formed with an engaging hole 39 recessed thereon. This engaging hole 39 engages with the valve body engaging portion 48 of the guide member 40 so that the valve body 38 integrally moves together with the guide member 40.

A compression coil spring 42 is housed in a compressed condition between the guide member 40 and the bottom wall 24 of the head cylinder 20. With the resilient force of the compression coil spring 42, the valve body 38 and the guide member 40 are firmly connected with each other and further the valve body 38 is pressed to fit to the inside surface of the tapered portion 30 around the front circumferential peripheral edge thereof as shown in FIG. 1.

Figure 2B:
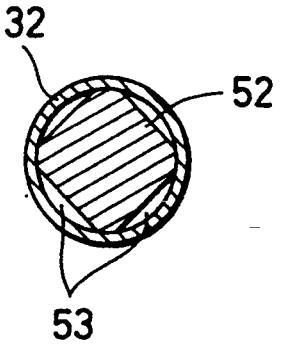
FIG. 2(B) is a cross-sectional plan view taken along the line B—B of FIG. 1.
Figure 3:
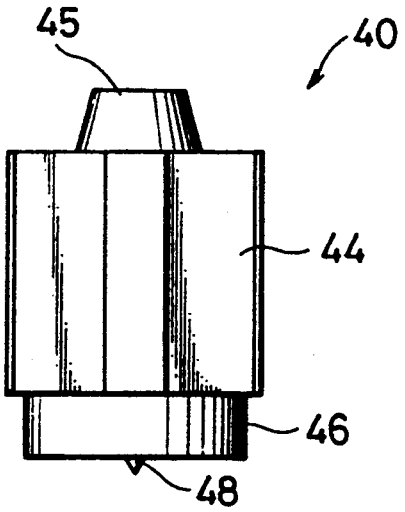
FIG. 3(A) is a front view showing a guide member accommodated in the first applying implement.
FIG. 3(B) is a front view showing a pen tip accommodated in the first applying implement.
Figure 3:
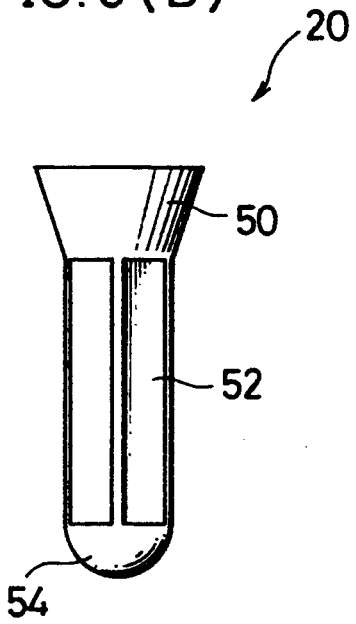
Figure 4:
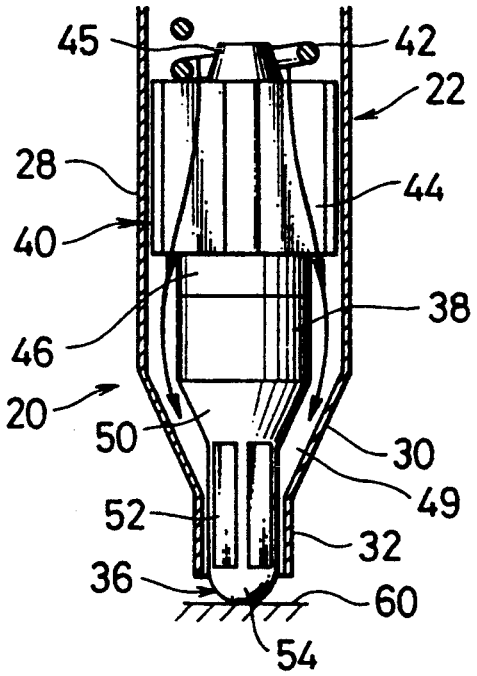
FIG. 4(A) is a cross-sectional front view showing a condition wherein the pen tip is retracted inward.
FIG. 4(B) cross-sectional front view showing is a condition wherein the pen tip is returned to protrude outward.
Figure 4:
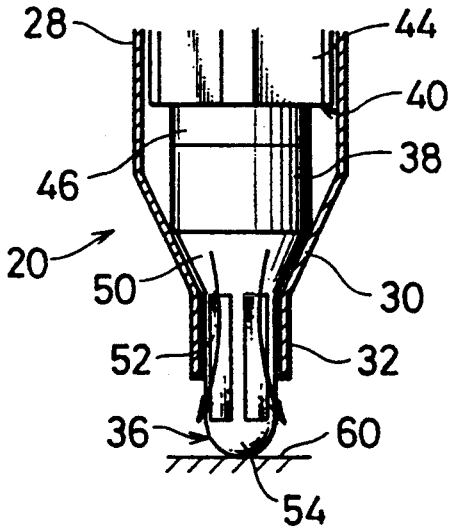

The pen tip 36, made of a hard material in the same manner as the head cylinder 20, comprises an engaging portion 50 of circular truncated cone, a rectangular column portion 52, and a semi-spherical portion 54 integrally formed in this order from the rear side. An inclined angle of the outer peripheral surface of the engaging portion 50 is equal to that of the tapered portion 30. Accordingly, the engaging portion 50 can firmly come into contact with the inside surface of the tapered portion 30 at a wider area around it. The rectangular column portion 52 has a cross section of substantially square so as to come into slidable contact at its four corners with the inside surface of the smaller-diameter cylindrical portion 32. It is, of course, preferable to provide a slight gap between the four corners of the rectangular column portion 52 and the inside surface of the smaller-diameter cylindrical portion 32. Four application fluid passages 53, - - - , 53 are provided between the rectangular column portion 52 and the smaller-diameter cylindrical portion 32 due to the difference of their cross sections as shown in FIG. 2(B).

When the engaging portion 50 comes into contact with the inside surface of the tapered portion 30, i.e. when the engaging portion 50 reaches the outermost (i.e. lowermost in FIG. 1) end, the rear end surface of the engaging portion 50 is spaced from the front end surface of the valve body 39 over a slight gap 56 as shown in FIG. 1. Namely, the pen tip 36 and the valve body 38 are mutually related in such a manner that the pen tip 36 is spaced from the valve body 38 when the pen tip 36 positions at its outermost end.

Next, an operation of the above applying implement will be described below.

First of all, in a case where the applying implement receives no external force, the valve body 38 is pressed to fit to the inside surface of the tapered portion 30 by the elastic force of the spring 42. Thus, this press fitting between the valve body 38 and the tapered portion 30 defines an excellent sealing against the application fluid. Thus, it becomes possible to prevent the application fluid from coming out through the front opening of the head cylinder 20.

As the valve body 38 is made of the soft and elastic material and spaced independently from the pen tip 36, the seal between the valve body 38 and the tapered portion 30 of the bead cylinder 20 is firmly maintained regardless of the condition (e.g. material, position, and others) of the pen tip 36. Furthermore, as the seal portion is located at an inner part behind the pen tip 36, foreign particles seldom reach this seal portion and the application fluid will not dry. Still further, even if the foreign particles enter there, the seal ability is not substantially worsened because the valve body 38 can cause elastic deformation.

As shown in FIG. 1, when facing downward, the pen tip 36 shifts downward because of its gravity until the engaging portion 50 of the pen tip 36 is stopped by the tapered portion 30. This structure prevents the pen tip 36 from falling out. As the inclined angle of the engaging portion 50 is identical with that of the tapered portion 30, the engaging portion 50 can come into contact with the tapered portion 30 at a wider area around it. Thus, the application fluid can be prevented from leaking out of the head cylinder 20.

Next, as shown in FIG. 4(A), if the semi-spherical portion 54 of the pen tip 36 is pressed against paper or the like material 60 to be supplied with fluid, the pen tip 36 shifts inward with respect to the head cylinder 20 due to reaction force. First of all, the pen tip 36 moves inward until it reaches the valve body 38. Then, the pen tip 36 and the valve body 38 integrally shift inward in the axial direction thereof against the elastic force of the compression coil spring 42. Thus, the pen tip 36 and the valve body 38 completely depart from the inside surface of the tapered portion 30.

In this case, a front side chamber 49 of the head cylinder 20, located in front of the valve body 38, quickly expands its volume. At this moment, the front side chamber 49 causes a negative pressure because introduction of air from outside is delayed by the resistance of the application fluid passages 53. Due to this negative pressure, an application fluid behind the valve body 38 is once introduced into the expanded space of the front side chamber 49 via the route shown by arrows in FIG. 4(A). Thereafter, if the pen tip 36 is released from the external force, the pen tip 36 returns to the outermost (i.e. lowermost in the drawing) position being urged by the compression coil spring 42. In response to this returning motion of the pen tip 36, a relatively small amount of application fluid, corresponding to the above expanded space, is extracted out of the head cylinder 20 as shown in FIG. 4(B) and then supplied onto the paper or the like material 60.

Accordingly, there is no need of squeezing the main body of the applying implement since it is possible to finely adjust the supply amount of the application fluid. It is of course possible to forcibly squeeze the main body in order to intentionally supply a large amount of application fluid. Furthermore, if a communication hole is opened at an appropriate portion of the main body so as to communicate the application fluid storage 14 to the outside for air exchange, this applying implement will be used for continuously writing.

Still further, the external force applied from the paper or the like material 60 to the pen tip 36 is softly transmitted to the user's hand because this force is transmitted through the soft and resilient valve body 38.

Moreover, since the smaller-diameter cylindrical portion 32 has an outer diameter smaller than that of the larger-diameter cylindrical portion 28, the user can easily see a target point to be supplied with the fluid. This will be especially advantageous when the application fluid is applied to a very small area.

As described above, the pen tip 36 and the valve body 38 are independent form each other. Therefore, even if the head cylinder 20 and the pen tip 36 are made of metal or inorganic material, the seal ability can be maintained nicely because the valve body 38 made of the soft and resilient material serves as an excellent seal member. Hence, the radiuses of both the head cylinder 20 and the pen tip 36 will be further reduced as long as the required strength is assured, without being bothered by the seal ability. With this arrangement, it becomes possible to supply an application fluid within a limited very small area.

Yet further, in accordance with the above first embodiment, the guide member 40 is interposed between the valve body 38 and the compression coil spring 42. This guide member 40 is partly formed into the rectangular column portion 44 having substantially square cross section capable of slidable contact with the inside surface of the head cylinder 20. Therefore, the guide member 40 and the valve body 38 can shift accurately in the axial direction being guided by the inside surface of the head cylinder 20. Thus, not only it becomes possible to prevent the guide member 40 and the valve body 38 from fluctuating in a radial direction but the application fluid passages 47, - - - , 47 having sufficient area can be formed between the guide member 40 and the head cylinder 20 as shown in FIG. 2(A).

In the same manner, the pen tip 36 is partly formed into the rectangular column portion 52 having substantially square cross section capable of slidable contact with the inside surface of the head cylinder 20. Therefore, the pen tip 36 can shift accurately in the axial direction being guided by the inside surface of the head cylinder 20. Thus, not only it becomes possible to prevent the pen tip 36 from fluctuating in the radial direction but the application fluid passages 53, - - - 53, having sufficient area can be formed between the pen tip 36 and the bead cylinder 20 as shown in FIG. 2(B).

Furthermore, the guide member 40 interposing between the soft valve body 38 and the compression coil spring 42 can serve as a protector for the valve body 38 made of soft material so as to prevent the rear (i.e. upper in the drawing) surface thereof from being damaged by the pressing force of the compression coil spring 42.

Moreover, as the valve body 38 is circular column, it can serve as a piston capable of generating strong extraction force when it returns from the retracted position of FIG. 4(A) to the protruding position of FIG. 4(B).

Still further, in accordance with this embodiment, the head cylinder 20 includes the bottom wall 24 and is formed into a container-like shape so that the compression coil spring 42 can be accommodated therein. Thus, the front end portion of the applying implement can be incorporated into a unit structure. Especially, it is advantageous in that no spring stopper is needed. Consequently, in the installation, the applying implement can be simply assembled by merely inserting the united head cylinder 20 accommodating the pen tip 36 and the compression coil spring 42 therein into the head cylinder installation hole 18 formed on the head cylinder holder 12.

Figure 5:
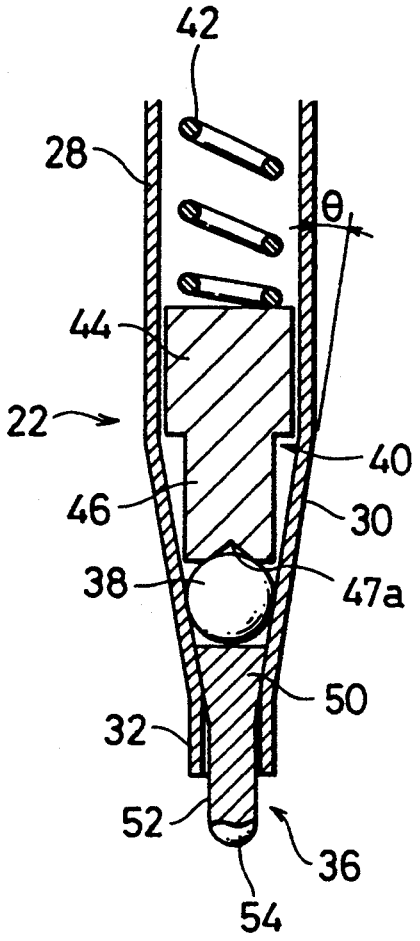
FIG. 5 is a cross-sectional front view showing an essential part of an applying implement in accordance with a second embodiment of the present invention.

Next, a second embodiment of the present invention will be described with reference to FIG. 5. In this second embodiment, the valve body 38 is formed into a ball shape. The guide member 40 has a front end surface formed with a recessed seat 47*a* for receiving the valve body 38.

In accordance with this structure, even if the inclined angle $\theta$ of the tapered portion 30 is set smaller, the ball-shaped valve body 38 can surely come into contact with the tapered portion 30 around it. Thus, excellent seal ability can be maintained. Hence, the larger-diameter cylindrical portion 28 of the head cylinder 20 can be thinned. Thus, application of fluid to the very limited small area can be easily accomplished. As a merit of ball-like shape of the valve body 38, this valve body 38 is pressed to fit into the tapered portion 30 like a wedge being urged by the elastic force of the compression coil spring 42. This is the reason why the excellent seal ability can be assured.

Figure 6:
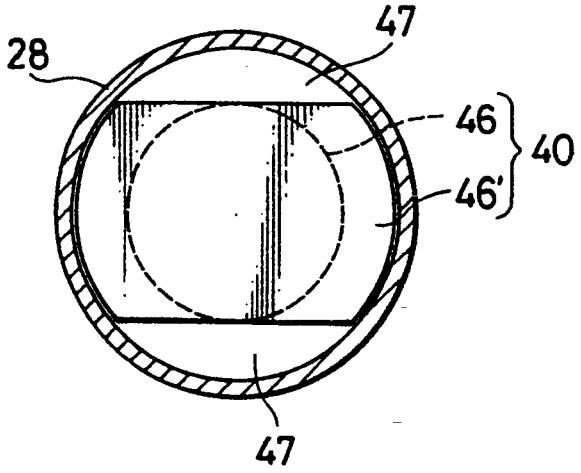
FIG. 6 is a partly sectional plan view showing a modified guide member.

In this embodiment, it is necessary that the guide member 40 has a lateral cross section different from that of the head cylinder 20. For example, the rectangular column portion 44 disclosed in the first embodiment can be replaced by a flange portion 46' shown in FIG. 6, wherein the flange portion 46' has two confronting circular arcs and two confronting parallel chords. The distance of two chords is identical with the diameter of the circular column portion It will be further possible to form the rectangular column portion 44 into polygonal shape other than square. Otherwise, the guide member 40 is formed into a circular column while the head cylinder 20 is formed into a shape other than the circular column.

Figure 7:
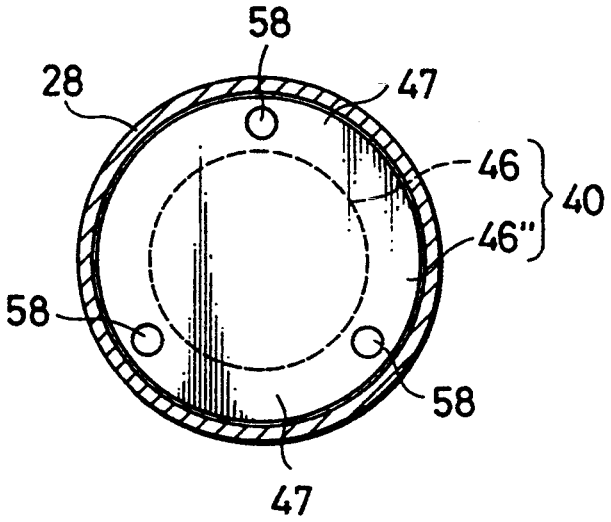
FIG. 7 is a partly sectional plan view showing another modified guide member.
Figure 8:
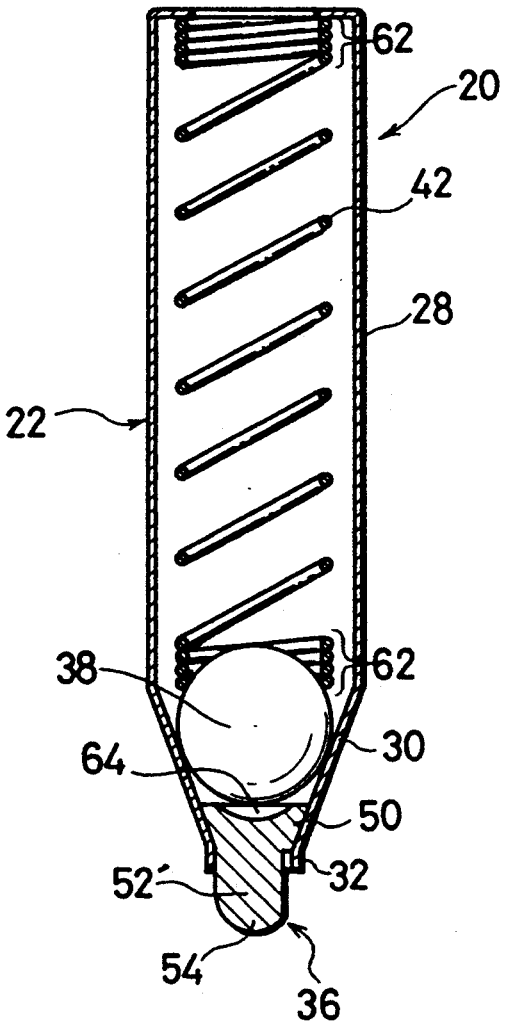
FIG. 8 is a cross-sectional front view showing an essential part of an applying implement in accordance with a third embodiment of the present invention.

Still further, it will be possible to provide a circular column portion 46" opened with several through holes 58, - - - , 58 as shown in FIG. 7. In this case, the circular column portion 46" comes into slidable contact with the inside surface of the larger-diameter cylindrical portion 28, and the through holes 58, - - - , 58 are opened radially outside the circular column portion 46 so as to define application fluid passages extending in the axial or longitudinal direction.

The above descriptions are similarly applied to the cross-sectional relationship between the pen tip 36 and the head cylinder 20.

Next, a third embodiment of the present invention will be described below.

In this third embodiment, the guide member 40 of the second embodiment is omitted and the outer diameter of the compression coil spring 42 is equal with the outer diameter of the ball-shaped valve body 38. Namely, the inner diameter of the compression coil spring 42 is slightly smaller than the outer diameter of the valve body 38. The ball-shaped valve body 38 is coupled or engaged with the lower end of the compression coil spring 42 at the top thereof.

The upper and lower ends of the compression coil spring 42 are respectively formed into an end coil portion 62 wherein adjacent wires of the coil spring abut with each other. The turning number of a lower end coil portion 62 is selected to be an appropriate number (for example, 4) so that the upper portion of the ball-shaped valve body 38 can be sufficiently inserted into the lower end coil portion 62.

Figure 9:
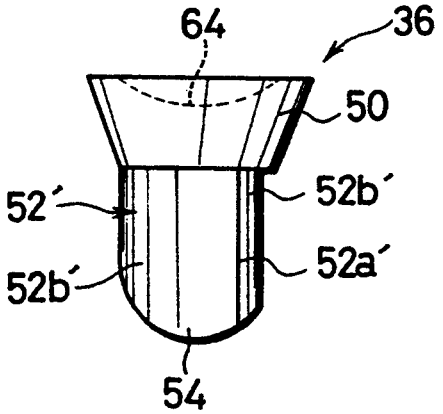
FIG. 9(A) is a front view showing a pen tip accommodated in the third applying implement.
FIG. 9(B) is a bottom view showing the pen tip accommodated in the third applying implement.
Figure 9:
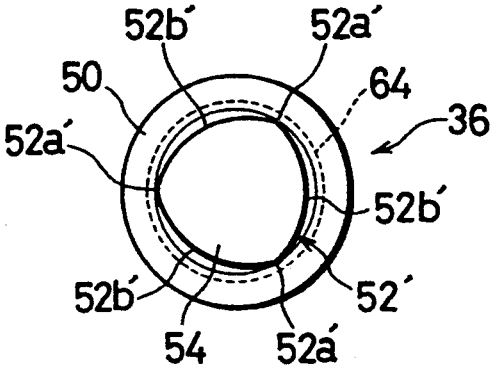
Figure 10:
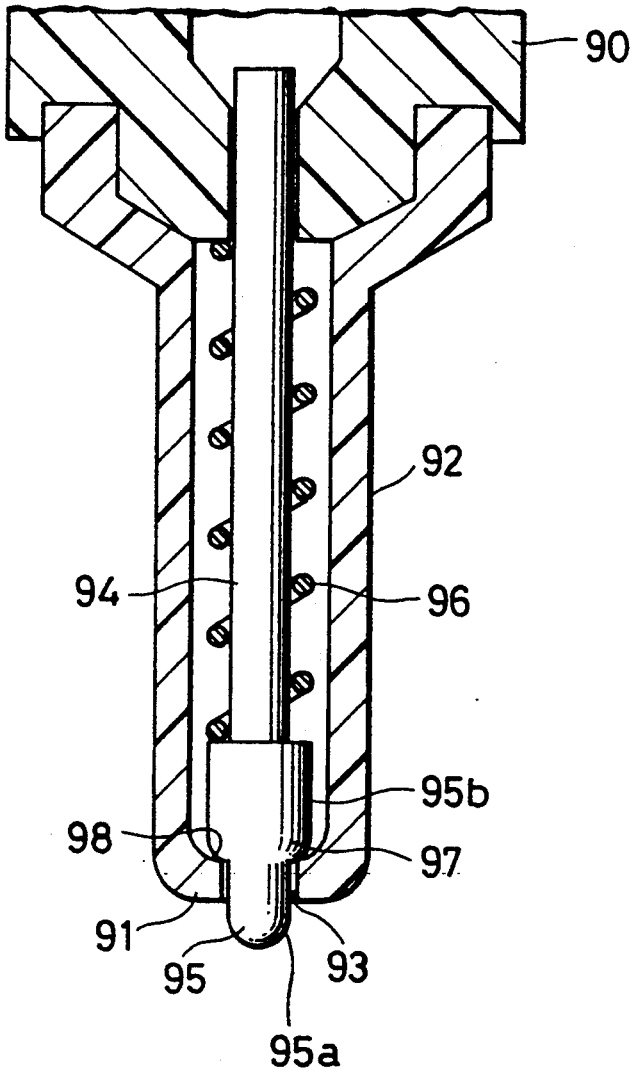
FIG. 10 PRIOR ART
FIG. 10 is a cross-sectional front view showing an applying implement of the prior art.

A modified cross-sectional portion 52' is provided between the engaging portion 50 and the semi-spherical portion 54. This modified cross-sectional portion 52' has three ridges 52*a'*, 52*a'*, and 52*a'* as shown in FIGS. 9(A) and 9(B), which come in to slidable contact with the inner surface of the small-diameter cylindrical portion 32 of the head cylinder 20. Three surfaces between these ridges 52*b'*, 52*b'*, and 52*b'* are respectively formed into a convex are surface having a curvature radius larger than the inner surface of the smaller-diameter cylindrical portion 32.

The engaging portion 50 has a rear (i.e. upper in the drawing) end surface formed with a recessed portion 64 for maintaining a clearance between the valve body 38 and the pen tip 36.

This third embodiment brings several effects as follows:

(a) The guide member 40 disclosed in the first and second embodiments can be omitted. Furthermore, as the valve body 38 is softly supported at the lower end portion of the compression coil spring 42, it becomes possible to prevent the valve body 38 from being damaged.

(b) As the lower end portion of the compression coil spring 42 is reinforced by being formed into the end coil portion 62, this end coil portion 62 performs the same function as the guide member 40. Thus, the valve body 38 can be stably supported. Especially, by selecting the turning number of the end coil portion 62 to be an appropriate value, the supporting of the valve body 38 is ensured.

(c) If the inner diameter of the compression coil spring 42 is too small, the supporting of the valve body 38 by the compression coil spring 42 becomes unstable. On the contrary, if the outer diameter of the compression coil spring 42 is too large, it is feared that the compression coil spring 42 will interfere with the inside surface of the cylindrical side wall 22. In this respect, the third embodiment sees the outer diameter of the compression coil spring 42 to be substantially the same as the outer diameter of the valve body 38. Thus, it becomes possible to firmly support the valve body 38 and the interference between the compression coil spring 42 and the cylindrical side wall 22 can be surely prevented. For instance, if the wire material of the compression coil spring 42 has a diameter of 0.15 mm, the compression coil spring 42 has an inner diameter smaller than the outer diameter of the valve body 38 by 0.3 mm. In this case, substantially the upper half of the valve body 38 is stably inserted into the compression coil spring 42.

(d) As the surfaces between the ridges 52*b'*, 52*b'*, and 52*b'* are outwardly protruding convex surfaces, frictional damage at the ridges 52*a'*, 52*a'*, and 52*a'* will be adequately suppressed compared with a normal triangular column. It is needless to say that a clearance between the modified cross-sectional portion 52' and the inside wall of the head cylinder 20 can be shortened. Furthermore, the number of the ridges 52*a'*, - - - , 52*a'* can be changed freely. The surfaces between the ridges 52*a'*, 52*a'*, and 52*a'* can be formed in other convex surfaces other than circular arc surfaces.

As this invention may be embodied in several forms without departing from the spirit of essential characteristics thereof, the present embodiments are therefore. Illustrative and not restrictive, since the scope of the invention is defined by the appending claims rather than by the description preceding them, and all changes that fall within meets and bounds of the claims, or equivalence of such meets and bounds are therefore intended to embraced by the claims.

What is claimed is:

1. An applying implement comprising:

a main body having an application fluid storage;

a hollow head cylinder mounted on said main body, said hollow head cylinder including a front end portion having an opening, a rear end portion having a communication hole communicating with said application fluid storage, and a tapered portion formed between said front and rear end portions so as to increase its radius as it advances rearward, said front end portion, said tapered portion, and said rear end portion of said hollow head cylinder being formed by a continuous wall of a substantially uniform thickness;

a valve body means in said hollow head cylinder, said valve body means comprising a valve body member of a soft and resilient material accommodated inside said hollow head cylinder so as to be slidable in an axial direction;

an urging means in said hollow head cylinder for resiliently urging said valve body means forward so that the valve body means can be firmly pressed against the inside surface of the tapered portion by the urging force of said urging means; and an application tip in said hollow head cylinder provided in front of and independent of said valve body means so as to be shiftable in the axial direction until said application tip, protrudes out of said hollow head cylinder, said application tip being spaced from a front edge of said valve body means when said application tip is shifted to an outermost position.

2. An applying implement in accordance with claim 1, wherein said hollow head cylinder and said application tip are made of a hard material selected from the group consisting of metal and an inorganic material.

3. An applying implement in accordance with claim 1, wherein said front end portion of said hollow head cylinder has a cross section smaller than that of said rear end portion of said hollow head cylinder.

4. An applying implement in accordance with claim 1, wherein said valve body means further comprises a guide member interposed between said urging means and said valve body member, said guide member being at least partly formed into a shape capable of slidable contact with the inside surface of said hollow head cylinder.

5. An applying implement in accordance with claim 1, wherein said application tip has an engaging portion engageable with the inside surface of the tapered portion of said hollow head cylinder.

6. An applying implement in accordance with claim 1, wherein said application tip is at least partly formed into a shape capable of slidable contact with the inside surface of said front end portion of said hollow head cylinder.

7. An applying implement in accordance with claim 6, wherein said application tip is at least partly formed with a cross-sectional portion having a plurality of ridges which come into slidable contact with the inner surface of the front end portion of said hollow head cylinder, and surfaces between said ridges formed into a convex arc surface having a radius of curvature larger than the radius of said inner surface of said front end portion of said hollow head cylinder.

8. An applying implement in accordance with claim 1, wherein said valve body member is formed into a circular column shape.

9. An applying implement in accordance with claim 1, wherein said valve body member is formed into a ball shape.

10. An applying implement in accordance with claim 9, wherein said urging means comprises a compression coil spring having an inner diameter smaller than an outer diameter of said valve body member, said valve body member being coupled into an end portion of said compression coil spring.

11. An applying implement in accordance with claim 10, wherein said end portion of said compression coil spring is formed into an end coil section wherein adjacent wires of said coil spring abut with each other, and the number of turns in said end coil section is selected so that the upper portion of the valve body member is received in said end coil section.

12. An applying implement in accordance with claim 10, wherein said compression coil spring has the same outer diameter as that of said valve body member.

13. An applying implement in accordance with claim 1, wherein said hollow head cylinder has a bottom wall having a through hole at the rear end portion thereof, said urging means comprising a compression coil spring interposed between said bottom wall and said valve body means, said main body being formed with a head cylinder installation hole communication with said application fluid storage, said hollow head cylinder being installed in said head cylinder installation hole.

14. An applying implement comprising:

a main body having an application fluid storage;

a hollow head cylinder mounted on said main body, said hollow head cylinder including a front end portion having an opening, a rear end portion having a communication hole communicating with said application fluid storage, and a tapered portion formed between said front and rear end portions so as to increase its radius as it advances rearward;

a valve body means in said hollow head cylinder, said valve body means comprising a valve body member of a soft and resilient material accommodated inside said hollow head cylinder so as to be slidable in an axial direction;

an urging means in said hollow head cylinder for resiliently urging said valve body means forward so that said valve body means can be firmly pressed against the inside surface of the tapered portion by the urging force of said urging means; and an application tip in said hollow head cylinder provided in front of and independent of said valve body means so as to be shiftable in the axial direction until said application tip protrudes out of said hollow head cylinder, said application tip being spaced from a front edge of said valve body means when said application tip is shifted to an outermost position, said application tip having an engaging portion engageable with the inside surface of the tapered portion of said hollow head cylinder.

15. An applying implement in accordance with claim 14 wherein said front end portion, said tapered portion and said rear portion of said hollow head cylinder are formed by a continuous wall of a substantially uniform thickness.

16. An applying implement in accordance with claim 14 wherein said engaging portion of said application tip has a partial conical configuration.

17. An applying implement in accordance with claim 14 wherein said application tip is shiftable from said outermost position independently of said valve body means.

18. An applying implement comprising:

a main body having an application fluid storage;

a hollow head cylinder mounted on said main body, said hollow head cylinder comprising a single casing which includes a front end portion having an opening, a rear end portion having a communication hole communicating with said application fluid storage, and a tapered portion formed between said front and rear end portions so as to increase its radius as it advances rearward;

a valve body means in said hollow head cylinder, said valve body means comprising a valve body member of a soft and resilient material accommodated inside said hollow head cylinder so as to be slidable in an axial direction;

an urging means in said hollow head cylinder for resiliently urging said valve body means forward so that said valve body means can be firmly pressed against the inside surface of the tapered portion by the urging force of said urging means;

said hollow head cylinder having a bottom wall with a through hole at the rear end portion thereof, said urging means comprising a compression coil spring interposed between said bottom wall and said valve body means, said main body being formed with a head cylinder installation hole communicating with said application fluid storage, said hollow head cylinder being installed in said head cylinder installation hole; and an application tip in said hollow head cylinder provided in front of and independent of said valve body means so as to be shiftable in the axial direction until said application tip protrudes out of said hollow head cylinder, said application tip being spaced from a front edge of said valve body means when said application tip is shifted to an outermost position.

19. An applying implement in accordance with claim 18 wherein said front end portion, said tapered portion and said rear portion of said hollow head cylinder are formed by a continuous wall of a substantially uniform thickness.

* * * * *